US009482068B2

(12) United States Patent
Lyle

(10) Patent No.: US 9,482,068 B2
(45) Date of Patent: Nov. 1, 2016

(54) HYDRAULIC LOCKDOWN

(71) Applicant: Vetco Gray Inc., Houston, TX (US)

(72) Inventor: Rockford Dee Lyle, Houston, TX (US)

(73) Assignee: Vetco Gray, Inc., Houston, TX (US)

( * ) Notice: Subject to any disclaimer, the term of this patent is extended or adjusted under 35 U.S.C. 154(b) by 0 days.

(21) Appl. No.: 14/578,028

(22) Filed: Dec. 19, 2014

(65) Prior Publication Data

US 2016/0177651 A1 Jun. 23, 2016

(51) Int. Cl.

| | |
|---|---|
| ***F16L 35/00*** | (2006.01) |
| ***E21B 33/035*** | (2006.01) |
| ***E21B 43/01*** | (2006.01) |
| ***E21B 29/12*** | (2006.01) |
| ***E21B 43/013*** | (2006.01) |
| ***E21B 33/038*** | (2006.01) |
| ***E21B 19/00*** | (2006.01) |

(52) U.S. Cl.

CPC ..... *E21B 33/038* (2013.01); *E21B 19/002* (2013.01)

(58) Field of Classification Search

None

See application file for complete search history.

(56) References Cited

U.S. PATENT DOCUMENTS 4,526,406 A * 7/1985 Nelson ..... E21B 33/038 285/18
6,234,252 B1 5/2001 Pallini
6,260,624 B1 * 7/2001 Pallini, Jr. ..... E21B 33/038 166/345
6,540,024 B2 4/2003 Pallini
6,554,324 B1 4/2003 Herman
2003/0145996 A1 8/2003 Singeetham et al.
2009/0014184 A1 1/2009 Voss et al.

OTHER PUBLICATIONS

PCT Search Report and Written Opinion issued in connection with corresponding PCT Application No. PCT/US2015/059219 on Mar. 11, 2016.

* cited by examiner

*Primary Examiner* — Matthew R Buck
*Assistant Examiner* — Douglas S Wood
(74) *Attorney, Agent, or Firm* — Bracewell LLP; James E. Bradley

(57) ABSTRACT

A subsea well connector for connecting a tubular member to a subsea wellhead assembly includes a tieback connector having an annular stationary connector body that circumscribes a portion of an annular moveable connector body. A tie rod with a tie rod profile extends axially from the stationary connector body. A dog ring circumscribes the tie rod and is moveable between a lockdown open position where the dog ring is spaced from the tie rod, and a lockdown engaged position where a dog ring inner diameter profile engages the tie rod profile, to axially couple the stationary connector body and the moveable connector body. An annular piston circumscribes the dog ring and has a region with a reduced inner diameter that engages an outer diameter of the dog ring to retain the dog ring in the lockdown engaged position. A cylinder circumscribes the annular piston, defining a lockdown piston cavity.

20 Claims, 2 Drawing Sheets

HYDRAULIC LOCKDOWN

BACKGROUND

1. Field of Invention

This invention relates in general to offshore drilling and production equipment and in particular to a tieback connector assembly for connecting a subsea wellhead assembly to a platform.

2. Description of Related Art

A subsea wellhead assembly installed at the sea floor may be in water thousands of feet deep. During completion and certain production operations, components from a floating platform are lowered from the platform to engage the subsea wellhead assembly. A tieback connector connects a production riser between a subsea wellhead housing and the surface production platform. Typically, the tieback connector has locking elements that lock into a profile in the wellhead housing. A lockdown mechanism is sometimes used to resist upward movement of the tieback connector and prevent unintentional unlocking of the tieback connector that may occur due to thermal growth and external environmental forces during production.

Some current lockdown mechanism designs include multiple lockdown members that are spaced around the circumference of the lockdown mechanism. Installing the lockdown mechanism usually requires a remotely operated vehicle (ROV) that manually manipulates a plate of each lockdown member with a grooved profile into engagement with a rod with a mating profile. In some subsea developments, the wells are located on a template, which provide limited access for a ROV, and it is very difficult for the ROV to move around and between the wells to make up the various lockdown members.

SUMMARY OF THE DISCLOSURE

The methods and systems of the current disclosure provide a connector assembly for connecting a tubular member to a subsea wellhead assembly having a lockdown system that can be operated and moved between a lockdown open position and a lockdown engaged position from a single location subsea by an ROV, or by an operator remotely from a surface location.

In an embodiment of this disclosure, a connector assembly for connecting a tubular member to a subsea wellhead assembly includes a tieback connector having a stationary connector body and a moveable connector body. The stationary connector body and the moveable connector body are annular members and the stationary connector body circumscribes a portion of the moveable connector body. A tie rod extends in an axial direction from the stationary connector body, the tie rod having a tie rod profile on a tie rod outer diameter. A dog ring with an inner diameter profile circumscribes the tie rod. The dog ring is moveable between a lockdown open position where the dog ring is spaced radially outward from the tie rod, and a lockdown engaged position where the inner diameter profile engages the tie rod profile, to axially couple the stationary connector body and the moveable connector body. An annular piston circumscribes the dog ring. The annular piston has a region with a reduced inner diameter that engages a dog ring outer diameter of the dog ring to retain the dog ring in the lockdown engaged position. A cylinder circumscribes the annular piston, defining a lockdown piston cavity.

In an alternate embodiment of this disclosure, a connector assembly for connecting a tubular member to a subsea wellhead assembly includes a tieback connector moveable between a connector engaged position where the connector assembly is secured to the subsea wellhead assembly, and a connector unengaged position where the connector assembly is moveable relative to the subsea wellhead assembly. A tie rod extends in an axial direction from the tieback connector, the tie rod having a tie rod profile on a tie rod outer diameter. A dog ring with an inner diameter profile circumscribes the tie rod, the dog ring moveable between a lockdown open position where the tie rod can move axially relative to the dog ring, and a lockdown engaged position where the inner diameter profile engages the tie rod profile and restricts the tieback connector from moving between the connector engaged position and the connector unengaged position. The dog ring is biased towards the lockdown open position. An annular piston circumscribes the dog ring. The annular piston has a region with a reduced inner diameter that engages a dog ring outer diameter of the dog ring to retain the dog ring in the lockdown engaged position, and a portion with an enlarged inner diameter that allows the dog ring to move to the lockdown open position. A cylinder circumscribes the annular piston, defining a lockdown piston cavity.

In another alternate embodiment of this disclosure, a method of connecting a tubular member to a subsea wellhead assembly includes landing a connector assembly on the subsea wellhead assembly. The connector assembly has an axially extending tie rod with a tie rod profile on a tie rod outer diameter. A dog ring with an inner diameter profile circumscribes the tie rod. An annular piston circumscribes the dog ring, and a cylinder that circumscribes the annular piston, defining a lockdown piston cavity. A pressure media is injected into the lockdown piston cavity to move the annular piston axially relative to the dog ring so that the dog ring is in a lockdown open position with the dog ring spaced from tie rod. The connector assembly is secured to the subsea wellhead assembly. The pressure media is vented from the lockdown piston cavity to allow the annular piston to move axially relative to the dog ring and the dog ring to move to the lockdown engaged position with the inner diameter profile engaging the tie rod profile, preventing the connector assembly from becoming unsecured from the subsea wellhead assembly.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE DISCLOSURE

Figure 1:
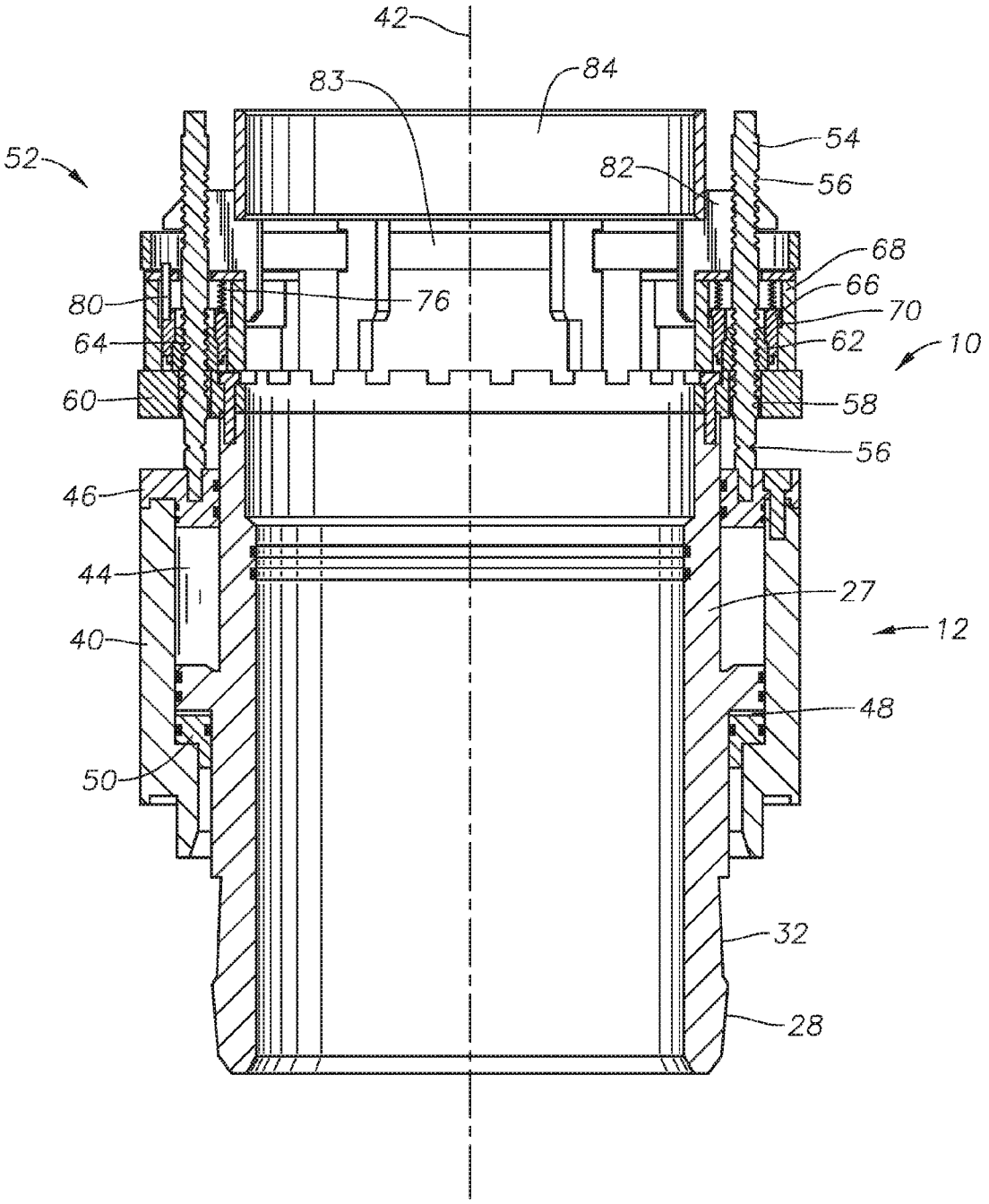
FIG. 1 is a section view of a connector assembly with a lockdown assembly in accordance with an embodiment of the current disclosure, shown with dog rings in a lockdown engaged position.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 2:
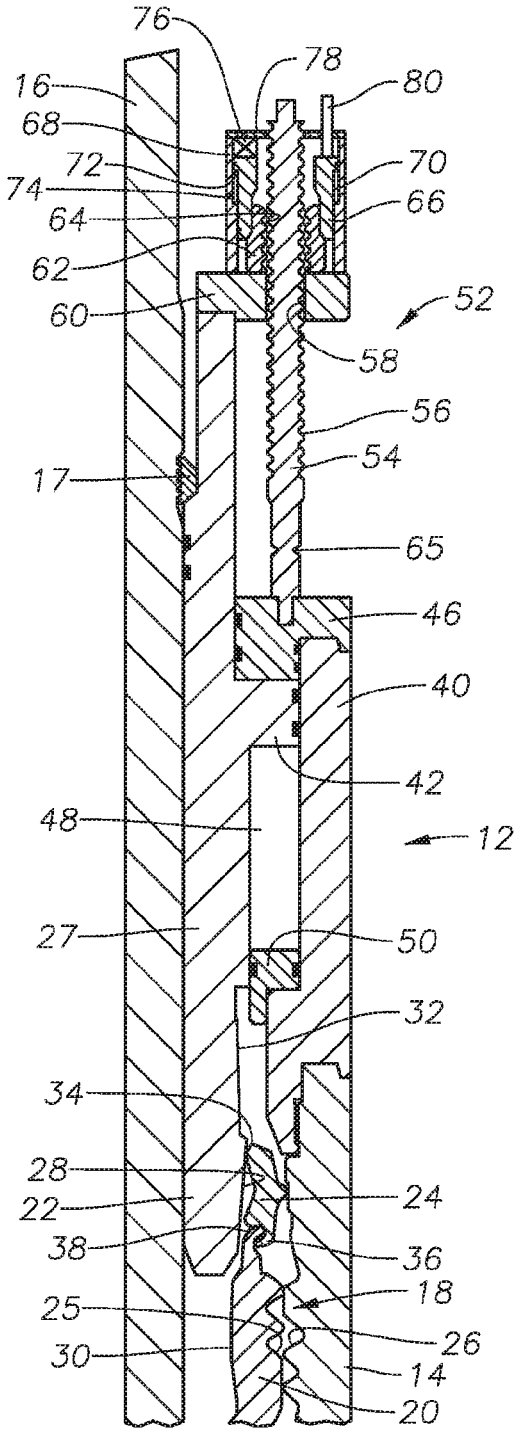
FIG. 2 is a section view of the connector assembly of FIG. 1, shown in a connector unengaged position and the lockdown assembly in a lockdown open position.
Figure 3:
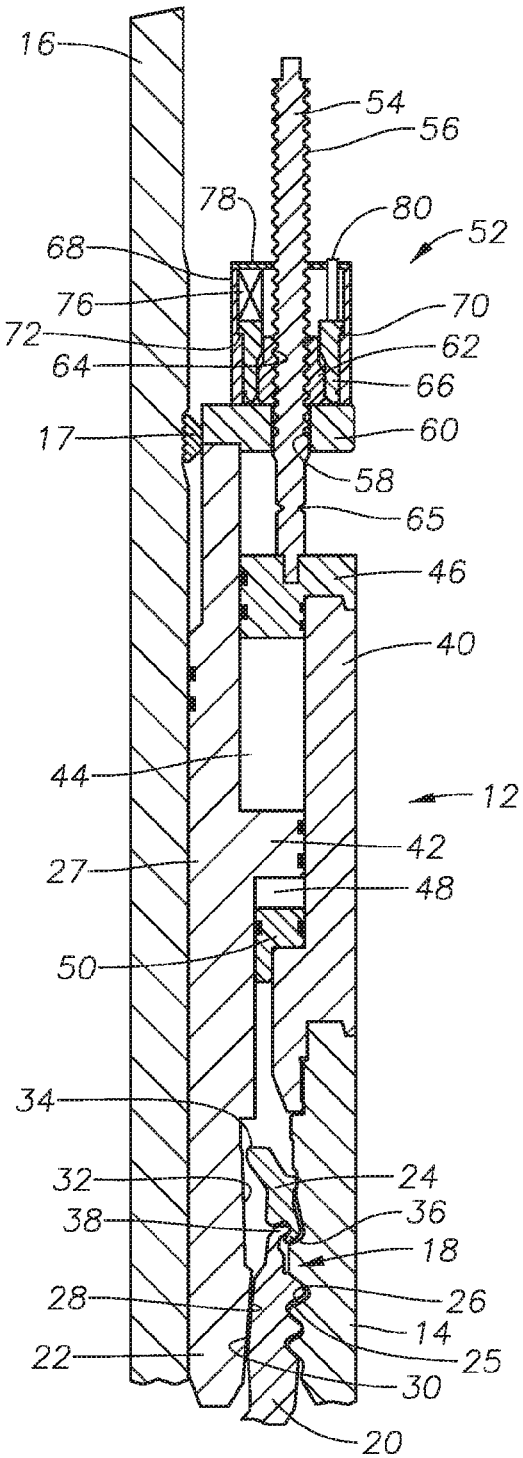
FIG. 3 is a section view of the connector assembly of FIG. 1, shown in a connector engaged position and the lockdown assembly in a lockdown engaged position.

Referring to FIGS. 1-3, an example configuration of connector assembly 10 includes tieback connector 12. Tieback connector 12 provides a primary connection between a subsea wellhead assembly (not shown) and a riser 16. Connector assembly 10 can be carried by riser 16. Connector assembly 10 can also include lock housing 14. Lock housing 14 is a tubular member and locks and preloads the connector assembly 10. A lower end of lock housing 14 can circumscribe, and lock to an outer diameter of, the wellhead assembly.

In the example of FIGS. 2-3, locking system 18 can secure connector assembly 10 in the locked position. Locking system 18 includes connector dogs 20, cam ring 22, and latch 24. Connector dogs 20 have a connector dogs profile 25 on an outer diameter that engages a locking profile 26 on an inner diameter of lock housing 14. Cam ring 22 can be formed on a lower portion of annular moveable connector body 27 of tieback connector 12. Cam ring 22 has a tapered nose and an outer diameter surface 28 that engages an inner diameter surface 30 of connector dogs 20, retaining connector dogs 20 in a radially outward position so that the connector dogs profile 25 engages the locking profile 26 and locking system 18 is in a connector engaged position (FIG. 3). In the connector engaged position, connector assembly 10 is secured to the lock housing 14 and the subsea wellhead assembly.

Cam ring 22 also includes a region with a reduced outer diameter 32 that is axially adjacent to the outer diameter surface 28, and which engages the inner diameter surface 30 of connector dogs 20. A tip 34 of latch 24 is alternately located axially adjacent outer diameter surface 28 and reduced outer diameter 32 of cam ring 22. When tip 34 of latch 24 is axially adjacent to, and engages, outer diameter surface 28, a lower lip 36 of latch 24 engages upper lip 38 of connector dogs 20, pushing connector dogs 20 radially inward so that connector dogs profile 25 is spaced from locking profile 26 (FIG. 2). In such an arrangement, locking system 18 is in a connector unengaged position and connector assembly 10 is moveable relative to lock housing 14 and the wellhead assembly. When tip 34 is axially adjacent to reduced outer diameter 32, latch 24 is pivoted so that connector dogs profile 25 can engage the locking profile 26 (FIG. 3) and locking system 18 can be in the connector engaged position.

Looking again at FIGS. 1-3, tieback connector 12 also includes moveable connector body 27 and stationary connector body 40. Both moveable connector body 27 and stationary connector body 40 are tubular members sharing a central axis 41. Stationary connector body 40 circumscribes a portion of moveable connector body 27. Stationary connector body 40 has a lower end that can be landed on an upper end of lock housing 14. Moveable connector body 27 can move axially relative to stationary connector body 40. Lock housing 14 extends downward from a bottom end of stationary connector body 40.

Moveable connector body 27 has an annular outer flange 42. Outer flange 42 extends radially outward from an outer diameter of moveable connector body 27. An outer diameter of outer flange 42 sealingly engages an inner diameter of stationary connector body 40. A seal is also formed between the outer diameter of moveable connector body 27 below outer flange 42 and above outer flange 42. Upper piston cavity 44 is an annular space defined by the outer diameter of moveable connector body 27, the inner diameter of stationary connector body 40, a bottom surface of connector cap 46 and an upper surface of outer flange 42. Connector cap 46 is a ring like cap that circumscribes moveable connector body 27 and sealing engages both the outer diameter of moveable connector body 27 and the inner diameter of stationary connector body 40. Connector cap 46 forms a static seal with the inner diameter of stationary connector body 40 and a dynamic seal with the outer diameter of moveable connector body 27 so that connector cap 46 can maintain a seal with moveable connector body 27 as moveable connector body 27 moves axially relative to stationary connector body 40. Connector cap 46 is secured to, and extends radially inward from, the top end of stationary connector body 40.

Lower piston cavity 48 is defined by the outer diameter of moveable connector body 27, the inner diameter of stationary connector body 40, a bottom surface of outer flange 42 and a top surface of annular seal 50. Annular seal 50 rests on an upward facing shoulder of stationary connector body 40 and engages both the outer diameter of moveable connector body 27 and the inner diameter of stationary connector body 40. Annular seal 50 forms a dynamic seal with the inner diameter of stationary connector body 40 and with the outer diameter of moveable connector body 27 so that annular seal 50 can maintain a seal with moveable connector body 27 and stationary connector body 40 as moveable connector body 27 moves axially relative to stationary connector body 40.

Upper piston cavity 44 and lower piston cavity 48 may be used to move the moveable connector body 27 relative to the stationary connector body 40. Injecting a pressure media into upper piston cavity 44 will cause the moveable connector body 27 to move axially downward relative to the stationary connector body 40 so that the locking system 18 moves to the connector engaged position shown in FIG. 3. The pressure media can be for example, a hydraulic fluid, pressurized air, or other suitable pressure fluid. Injecting a pressure media into lower piston cavity 48 will cause the moveable connector body 27 to move axially upward relative to the stationary connector body 40 so that the locking system 18 moves to the connector unengaged position shown in FIG. 2. Retaining ring 17 can engage an inner diameter shoulder of connector assembly 10, to restrict the axial extent of the movement of connector body 27 as the connector is moved to the unengaged position. As moveable connector body 27 moves axially relative to stationary connector body 40 during such process, riser 16 remains stationary and an inner diameter surface of moveable connector body 27 will glidingly and sealingly engage an outer diameter surface of riser 16.

Looking again at FIGS. 1-3, connector assembly 10 includes lockdown assembly 52. Lockdown assembly 52 provides a mechanism for maintaining the connection between a subsea wellhead assembly and a riser 16 with locking system 18 provided by tieback connector 12, by preventing relative axial movement between moveable connector body 27 and stationary connector body 40.

Lockdown assembly 52 includes tie rod 54. A lower end of tie rod 54 is attached to connector cap 46, which in turn is secured to stationary connector body 40 of tieback connector 12. Tie rod 54 extends in an axially upward direction from connector cap 46 of tieback connector 12. Tie rod 54 passes through a hole 58 in annular ring 60. Tie rod 54 has a tie rod profile 56 on a tie rod outer diameter of tie rod 54. Tie rod 54 can have two separate axial lengths of tie rod profile 56, or a single continuous length of tie rod profile 56. Lockdown assembly 52 can include a plurality of tie rods 54 spaced around a circumference of stationary connector body 40 of tieback connector 12. Each tie rod 54 will have the components associated with the tie rod 54, as discussed herein.

Annular ring 60 is secured to an upper end of moveable connector body 27 and extends radially outward from moveable connector body 27. Annular ring 60 can be secured to the upper end of moveable connector body 27, as an example, with pins, bolts, or other threaded members. Annular ring 60 has an inner diameter that is generally equivalent to, or larger than, an inner diameter of moveable connector body 27. An outer diameter of annular ring 60 can be generally equivalent to, or less than, an outer diameter of stationary connector body 40.

Dog ring 62 is an annular member that has an inner diameter profile 64 and circumscribes tie rod 54. Dog ring 62 can be supported by an upper surface of annular ring 60. Dog ring 62 is formed to be biased in a radially outward position so that in a relaxed state, dog ring 62 is in a lockdown open position and inner diameter profile 64 is spaced apart from tie rod profile 56. Dog ring 62 is radially contractible and can be, for example, a c-ring or other outwardly biased ring shaped member. Dog ring 62 is moveable between a lockdown open position where dog ring 62 is spaced from tie rod 54, and a lockdown engaged position where inner diameter profile 64 engages tie rod profile 56.

In the lockdown open position, tie rod 54 can move axially relative to dog ring 62 so that moveable connector body 27 can move axially relative to stationary connector body 40. In the lockdown engaged position, tie rod 54 couples to dog ring 62, preventing relative axial movement between moveable connector body 27 and stationary connector body 40. Dog ring 62 can be in a lockdown engaged position when tieback connector 12 is either in the connector unengaged position or in the connector engaged position. When tieback connector 12 is in the connector engaged position and dog ring 62 is in a lockdown engaged position, tieback connector 12 will remain in the connector engaged position until dog ring 62 is moved to the lockdown open position. Similarly, when tieback connector 12 is in the connector unengaged position and dog ring 62 is in a lockdown engaged position, tieback connector 12 will remain in the connector unengaged position until dog ring 62 is moved to the lockdown open position. However, tie rod 54 can include radial groove 65 that will act as a weak or shear point of tie rod 54. If tieback connector 12 was to be hydraulically actuated to move between a connector engaged position and a connector unengaged position and the operator failed to first move dog ring 62 to the lockdown open position, tie rod 54 would shear at radial groove 65 before damage occurred to any more expensive or safety critical component. Radial groove 65 will therefore act as a safety feature to sacrifice tie rod 54, which can then be replaced.

Lockdown assembly 52 further includes annular piston 66 that is an annular member and circumscribes dog ring 62. Annular piston 66 can move axially relative to dog ring 62. Annular piston 66 has a portion with an enlarged inner diameter at a lower end of annular piston 66. When annular piston 66 is in an axially upper position and the portion with the enlarged inner diameter of annular piston 66 engages a dog ring outer diameter of dog ring 62, dog ring 62 can be in the lockdown open position (FIG. 2). Annular piston 66 also has a region with a reduced inner diameter located at an upper end of annular piston 66. When annular piston 66 is in an axially lower position and the region with the reduced inner diameter of annular piston 66 engages a dog ring outer diameter of dog ring 62, dog ring 62 is retained in the lockdown engaged position (FIGS. 1 and 3).

Cylinder 68 circumscribes annular piston 66. Cylinder 68 is an annular member with an inner bore. Lockdown piston cavity 70 is defined between an inner diameter of cylinder 68 and an outer diameter of annular piston 66. Cylinder 68 has an inner diameter that sealing engages an outer diameter of a radially extending flange 72 of annular piston 66. Flange 72 extends radially inward from a top end of annular piston 66. A bottom surface of flange 72 defines a top of piston cavity 70. An upward facing radial shoulder of cylinder 68 defines a bottom of piston cavity 70.

A pressure media injected into lockdown piston cavity 70 can cause annular piston 66 to move upward relative to dog ring 62 so that dog ring 62 can expand radially outward and move to the lockdown open position. The pressure media can be for example, a hydraulic fluid, pressurized air, or other suitable pressure fluid. The pressure media can be injected into lockdown piston cavity 70 through injection port 74 (FIG. 2) that extends through a sidewall of cylinder 68. Injection port 74 can be part of a pressure system that provides fluid communication between injection ports 74 of the cylinders 68 associated with each of the plurality of tie rods 54. The pressure system can be pressurized by an ROV (not shown) subsea or remotely by an operator at an above water surface location.

Lockdown assembly 52 can also include biasing member 76. Biasing member 76 urges annular piston 66 downwards to retain dog ring 62 in the lockdown engaged position. Biasing member 76 has a first end engaging a top surface of annular piston 66 and a second end engaging cylinder cap 78. Cylinder cap 78 is a disk shaped member located at an upper end of cylinder 68. In order to move annular piston axially upward relative to dog ring 62, the force of biasing member 76 will need to be overcome by the force of the pressure media injected into lockdown piston cavity 70.

Lockdown assembly 52 can further include indicator stem 80. Indicator stem 80 can engage a top surface of annular piston 66 and protrude through cylinder cap 78. Indicator stem 80 can include a marking that can be visualized by camera, such as a camera associated with an ROV, to indicate to the axially position of the annular piston 66 to the operator so the operator can determine if dog ring 62 is in the lockdown open position or the lockdown engaged position.

Although lockdown assembly 52 is described herein for use with tieback connector 12, lockdown assembly 52 can be used with alternate connector assemblies that have a moveable piston portion and a stationary body for attachment to tie rod 54.

In an example of operation, in order to connect a tubular member to a subsea wellhead, connector assembly 10 can be landed on a subsea wellhead assembly. During the lowering of connector assembly 10 onto the subsea wellhead assembly, tieback connector 12 can be in the connector unengaged position and dog ring 62 can be in the lockdown engaged position to retain tieback connector 12 in the connector unengaged position.

Injecting a pressure media through injection port 74 and into lockdown piston cavity 70 will move annular piston 66 axially upward relative to dog ring 62 so that radially outward biased dog ring 62 moves to a lockdown open position with tie rod 54 spaced from dog ring 62. This allows moveable connector body 27 to move axially relative to stationary connector body 40 so that tieback connector 12 can then be moved to the connector engaged position. Pressure media can be injected into lockdown piston cavity 70 by, for example, remotely signaling a pressure system from an above water surface location or by signaling a pressure system from a subsea location, such as by signaling the pressure system subsea with an ROV.

Tieback connector 12 is moved to the connector engaged position by injecting pressure media into upper piston cavity 44, moving moveable connector body 27 axially downward relative to stationary connector body 40 so that cam ring 23 moves connector dogs profile 25 into engagement with locking profile 26, securing connector assembly 10 to lock housing 14. During this procedure, tie rod 54 moves axially relative to dog ring 62.

Venting the pressure media from lockdown piston cavity 70 then allows biasing member 76 to push annular piston 66 axially downward relative to dog ring 62, moving dog ring 62 to the lockdown engaged position with inner diameter profile 64 engaging tie rod profile 56. The pressure media can be vented from lockdown piston cavity 70 through injection port 74 or though a separate venting port that extends through the sidewall of cylinder 68. With the region with the reduced inner diameter of annular piston 66 engaging a dog ring outer diameter of dog ring 62, dog ring 62 is retained in the lockdown engaged position, preventing connector assembly 10 from becoming unsecured from the subsea wellhead assembly. Because of the axial movement of tie rod 54 relative to dog ring 62 during the securing of connector assembly 10 to lock housing 14, inner diameter profile 64 will now engage tie rod profile 56 at an axially lower position on tie rod 54 than it did during the lowering of connector assembly 10 onto the subsea wellhead assembly when tieback connector 12 was retained in the connector unengaged position.

The procedure can be reversed to remove connector assembly 10 from subsea wellhead assembly 14. Pressure media can be through injection port 74 and into lockdown piston cavity 70 to move annular piston 66 axially upward relative to dog ring 62 so that radially outward biased dog ring 62 moves to a lockdown open position with tie rod 54 spaced from dog ring 62. Tieback connector 12 can then be moved to the connector unengaged position by injecting pressure media into lower piston cavity 48, moving moveable connector body 27 axially upward relative to stationary connector body 40 so that cam ring 23 is no longer axially even with connector dogs profile 25 and connector dogs profile 25, is no longer in engagement with locking profile 26 and tieback connector 12 is in the connector unengaged position. Latch 24 is pivoted to retain connector dogs profile 25 spaced apart from locking profile 26 and connector assembly 10 can be removed from the subsea wellhead assembly. Venting the pressure media from lockdown piston cavity 70 can allow biasing member 76 to push annular piston 66 axially downward relative to dog ring 62, moving dog ring 62 to the lockdown engaged position with inner diameter profile 64 engaging tie rod profile 56. With the region with the reduced inner diameter of annular piston 66 engaging a dog ring outer diameter of dog ring 62, dog ring 62 is retained in the lockdown engaged position so that tieback connector 12 is retained in the connector unengaged position while connector assembly 10 is removed from the subsea wellhead assembly.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A subsea well connector for connecting a tubular member to a subsea wellhead assembly, comprising:

a tieback connector having a stationary connector body and a moveable connector body, the stationary connector body and the moveable connector body being annular members and the stationary connector body circumscribing a portion of the moveable connector body;

a tie rod extending in an axial direction from the stationary connector body, the tie rod having a tie rod profile comprising a plurality of axially spaced apart tie rod grooves on a tie rod outer diameter;

at least one dog ring mounted to the moveable connector body, the dog ring having an inner diameter profile circumscribing the tie rod, the dog ring being moveable between a lockdown open position where the inner diameter profile of the dog ring is spaced radially outward from the tie rod grooves, and a lockdown engaged position where the inner diameter profile engages the tie rod profile, to axially couple the stationary connector body and the moveable connector body, wherein the tie rod profile extends an axial height along the tie rod that is greater than an axial height of the inner diameter profile such that in the lockdown engaged position, the inner diameter profile is operable to engage different ones of the tie rod grooves of the tie rod profile at a plurality of axial locations along the tie rod profile;

an annular piston circumscribing the dog ring, the annular piston having a region with a reduced inner diameter that engages a dog ring outer diameter of the dog ring to retain the dog ring in the lockdown engaged position; and a cylinder that circumscribes the annular piston, defining a lockdown piston cavity.

2. The subsea well connector according to claim 1, further comprising an annular ring secured to an upper end of the moveable connector body, wherein the tie rod passes through a hole that extends axially through the annular ring, and wherein the dog ring is supported by an upper surface of the annular ring.

3. The subsea well connector according to claim 1, wherein the dog ring profile comprises a plurality of axially spaced apart dog ring grooves.

4. The subsea well connector according to claim 3, wherein there are fewer of the dog ring grooves than the tie rod grooves.

5. The subsea well connector according to claim 1, further comprising an injection port extending through the cylinder and into the lockdown piston cavity, selectively receiving a pressure media for moving the annular piston upward to allow the dog ring to move to the lockdown open position.

6. The subsea well connector according to claim 1, the tieback connector further comprising a locking system, the locking system being moveable between a connector engaged position where the tieback connector is secured to a lock housing of the subsea well connector and a connector unengaged position where the tieback connector is moveable relative to the lock housing, the locking system being moveable between the connector engaged position and the connector unengaged position by relative axial movement between the stationary connector body and the moveable connector body.

7. The subsea well connector according to claim 6, wherein the dog ring can be in the lockdown engaged position when the tieback connector is in the connector engaged position and when the tieback connector is in the connector unengaged position.

8. The subsea well connector according to claim 1, wherein the at least one tie rod comprises a plurality of the tie rods spaced around a circumference of the stationary connector body.

9. A subsea well connector for connecting a tubular member to a subsea wellhead assembly, comprising:

a tieback connector moveable between a connector engaged position where the connector assembly is secured to the subsea wellhead assembly, and a connector unengaged position where the connector assembly is moveable relative to the subsea wellhead assembly;

at least one tie rod extending in an axial direction from the tieback connector, the tie rod having a tie rod profile comprising a set of axially spaced apart tie rod grooves on a tie rod outer diameter;

at least one dog ring with an inner diameter profile comprising a set of axially spaced apart dog ring grooves circumscribing the tie rod, the dog ring being moveable between a lockdown open position where the tie rod can move axially relative to the dog ring, and a lockdown engaged position where the dog ring grooves engage the tie rod grooves and restricts the tieback connector from moving between the connector engaged position and the connector unengaged position, wherein the set of tie rod grooves extends an axial height along the tie rod that is greater than an axial height of the set of dog ring grooves such that in the lockdown engaged position, the set of dog ring grooves is operable to engage the set of tie rod grooves at a plurality of different axial locations along the set of tie rod grooves;

an annular piston circumscribing the dog ring, the annular piston having a region with a reduced inner diameter that engages a dog ring outer diameter of the dog ring to retain the dog ring in the lockdown engaged position and a region with an enlarged inner diameter that allows the dog ring to move to the lockdown open position; and a cylinder that circumscribes the annular piston, defining a lockdown piston cavity.

10. The subsea well connector according to claim 9, wherein the tieback connector includes a stationary connector body and a moveable connector body, the stationary connector body and the moveable connector body being annular and the stationary connector body circumscribing a portion of the moveable connector body, and wherein relative axial movement between the stationary connector body and the moveable connector body moves the tieback connector between the connector engaged position where the connector assembly is secured to the subsea wellhead assembly and the connector unengaged position where the connector assembly is moveable relative to the subsea wellhead assembly.

11. The subsea well connector according to claim 9, further comprising an annular shear point of reduced diameter on the tie rod outer diameter below the tie rod grooves for causing the tie rod to shear in the event the dog ring fails to move to the lockdown open position when directed.

12. The subsea well connector according to claim 9, wherein the cylinder has an inner diameter that sealingly engages an outer diameter of a radially extending flange of the annular piston, the cylinder further comprising an injection port extending through the cylinder and into the lockdown piston cavity, the lockdown piston cavity selectively receiving a pressure media for moving the annular piston upward to allow the dog ring to move to the lockdown open position.

13. The subsea well connector according to claim 9, wherein the set of dog ring grooves alternately selectively engages the set of tie rod grooves and restricts the tieback connector in the connector engaged position and also selectively engages the set of tie rod grooves and restricts the tieback connector in the connector unengaged position.

14. The subsea well connector according to claim 9, wherein the at least one tie rod a plurality of the tie rods spaced around a circumference of the tieback connector, and the least one dog ring comprises a plurality of the dog rings each of the dog rings being simultaneously moved between the lockdown open position and the lockdown engaged position.

15. A method of connecting a tubular member to a subsea wellhead assembly, the method comprising:

(a) landing a connector assembly on the subsea wellhead assembly, the connector assembly having an axially extending tie rod with a tie rod profile comprising a plurality of axially spaced apart tie rod grooves on a tie rod outer diameter, a dog ring with an inner diameter profile circumscribing the tie rod, an annular piston circumscribing the dog ring, and a cylinder that circumscribes the annular piston, defining a lockdown piston cavity, wherein the tie rod grooves extend an axial height along the tie rod that is greater than an axial height of the inner diameter profile such that the in the lockdown engaged position, the inner diameter profile is engageable with the tie rod grooves at a plurality of different axial locations along the tie rod grooves;

(b) injecting a pressure media into the lockdown piston cavity to move the annular piston axially relative to the dog ring so that the dog ring is in a lockdown open position with the dog ring profile radially spaced from the tie rod profile;

(c) securing the connector assembly to the subsea wellhead assembly; and (d) moving the annular piston axially relative to the dog ring and the tie rod to move the dog ring to a lockdown engaged position with the dog ring profile engaging the tie rod grooves, preventing the connector assembly from becoming unsecured from the subsea wellhead assembly.

16. The method according to claim 15, wherein the dog ring profile comprises a plurality of axially spaced apart dog ring grooves.

17. The method according to claim 15, wherein securing the connector assembly to the subsea wellhead assembly includes moving a moveable connector body of the connector assembly axially relative to a stationary connector body of the connector assembly so that the dog ring moves axially in unison with the moveable connector body relative to the tie rod.

18. The method according to claim 15, wherein the dog ring profile comprises a plurality of axially spaced apart dog ring grooves.

19. The method according to claim 15, wherein step (b) is performed by remotely signaling a pressure system from an above water surface location.

20. The method according to claim 15, wherein step (b) is performed by signaling a pressure system from a subsea location.

* * * * *